US007117643B2

(12) United States Patent
Brown

(10) Patent No.: US 7,117,643 B2
(45) Date of Patent: Oct. 10, 2006

(54) COVERED RAIN GUTTER

(75) Inventor: Lee J. Brown, Cincinnati, OH (US)

(73) Assignee: The Guttershutter Manufacturing Company, Cincinnati, OH (US)

( * ) Notice: Subject to any disclaimer, the term of this patent is extended or adjusted under 35 U.S.C. 154(b) by 203 days.

(21) Appl. No.: 10/724,667

(22) Filed: Dec. 1, 2003

(65) Prior Publication Data

US 2005/0115158 A1 Jun. 2, 2005

(51) Int. Cl.
*E04D 13/064* (2006.01)

(52) U.S. Cl. ..... 52/12; 52/13; 52/15; 248/48.2

(58) Field of Classification Search ..... 52/11–15, 52/96; 248/48.1–48.2
See application file for complete search history.

(56) References Cited

U.S. PATENT DOCUMENTS

| | | | | | |
|---|---|---|---|---|---|
| 546,042 | A | | 9/1895 | Van Horn | 52/12 |
| 891,405 | A | | 6/1908 | Cassens | 210/474 |
| 891,406 | A | | 6/1908 | Cassens | 210/542 |
| 2,672,832 | A | | 3/1954 | Goetz | 52/12 |
| 3,545,144 | A | * | 12/1970 | Sickler | 52/11 |
| 4,404,775 | A | | 9/1983 | Demartini | 52/12 |
| 4,455,791 | A | | 6/1984 | Elko et al. | 52/12 |
| 4,497,146 | A | | 2/1985 | Demartini | 52/12 |
| 4,757,649 | A | | 7/1988 | Vahldieck | 52/12 |
| 5,189,849 | A | | 3/1993 | Collins | 52/12 |
| 5,495,694 | A | | 3/1996 | Kuhns | 52/12 |
| 5,557,891 | A | | 9/1996 | Albracht | 52/12 |
| 5,737,879 | A | * | 4/1998 | Sweet | 52/12 |
| 5,845,435 | A | | 12/1998 | Knudson | 52/11 |
| 5,878,533 | A | * | 3/1999 | Swanfeld, Jr. | 52/11 |
| 6,098,344 | A | | 8/2000 | Albracht | 52/12 |
| 6,412,228 | B1 | | 7/2002 | Meckstroth | 52/12 |
| 6,453,622 | B1 | * | 9/2002 | Walters | 52/12 |
| 6,470,628 | B1 | | 10/2002 | Walters | 52/12 |
| 6,493,993 | B1 | | 12/2002 | Serano | 52/12 |
| 6,681,527 | B1 | * | 1/2004 | Baker | 52/12 |
| 6,745,517 | B1 | * | 6/2004 | Vahldieck | 52/12 |
| 6,931,792 | B1 | * | 8/2005 | McDonald et al. | 52/12 |
| 2005/0082436 | A1 | * | 4/2005 | Snell | 248/48.2 |

FOREIGN PATENT DOCUMENTS

| | | | |
|---|---|---|---|
| JP | 2003-82827 | * | 3/2003 |

OTHER PUBLICATIONS

Solution Company, Inc. Internet web page, "Gutter Solution," www.buildingsolution.com/gutters/, date unknown, printed Jan. 23, 2003.

* cited by examiner

*Primary Examiner*—Winnie Yip
(74) *Attorney, Agent, or Firm*—Alfred J. Mangels

(57) ABSTRACT

A rain gutter that includes an overlying, leaf- and debris-shedding cover. The gutter is in the form of a channel having an upwardly-facing opening. The cover overlies the channel opening and includes a convex front edge that is spaced from the front edge of the channel to define a gap or opening between the cover and the channel to allow water to flow around the convex front edge and into the channel. A series of support brackets are positioned within the gutter channel and interconnect the gutter and the cover to provide a rigid gutter structure. An end cap is provided at each end of the gutter and overlies both the gutter channel section and the space between the channel section and the cover, to prevent entry of leaves and debris into the channel through the ends of the gutter.

33 Claims, 7 Drawing Sheets

COVERED RAIN GUTTER

BACKGROUND OF THE INVENTION

1. Field of the Invention

The present invention relates to a rain gutter that includes an overlying cover for deflecting leaves and other debris from entering the gutter trough and causing gutter clogging. More particularly, the present invention relates to a covered rain gutter that includes spaced mounting brackets that securely and rigidly support the gutter trough on a building fascia board, or the like, and that securely and rigidly support the gutter cover in a predetermined position relative to the gutter trough.

2. Description of the Related Art

Rain gutters for collecting rain runoff from pitched building roofs are generally U-shaped open troughs that are arranged along the roof line of the building and in a position to catch the surface water runoff from the roof. Such gutters are usually connected to a fascia board on the building and include one or more downspouts to carry away the roof water runoff and direct it in a desired direction away from the building.

Rain gutters that are open in an upward direction will collect leaves and other wind-blown debris, as well as the rain runoff. The accumulation of leaves and other debris within an open gutter ultimately leads to gutter and downspout opening clogging, thereby causing undesired gutter overflow. Restoration of proper gutter function requires that the collected leaves and debris be removed, an operation that usually requires climbing a ladder and physically removing the collected matter, which is a tedious, time-consuming process, and one that is potentially dangerous because it involves climbing a ladder to the building roof line.

Various gutter arrangements have been proposed and developed over the years in an effort to solve the rain-gutter-cleaning problem by blocking the entry into the gutter of leaves and debris. One approach involves the installation over the gutter top opening of a screen or mesh material. The screen or mesh has a number of small openings that are so sized as to allow water to enter the gutter trough while screening out or blocking leaves and other debris from entering the gutter. However, many such screening arrangements have the screening element positioned horizontally over the gutter top opening, or at a very slight inclination, thereby allowing the collection of leaves and debris on the surface of the screening, leading to external gutter clogging rather than internal gutter clogging. Further, the stems of leaves often extend into the screening openings, thereby serving to retain the leaves on the surface of the screening material and preventing their being blown off by the wind.

Another approach that has been developed to block the entry into gutters of leaves and debris is a cover that overlies the gutter top opening. The cover is intended to serve as a deflector of leaves and other debris so that they either are blown off the cover by the wind, or they fall over the front edge of the gutter while allowing the rain water to flow over the outer edge of the cover and into the gutter for collection and disposal. Although several approaches to configuring and supporting a gutter cover have been disclosed, those approaches are either cumbersome and time consuming from an installation standpoint, are costly in terms of amount of attachment materials needed, or are not particularly rigid in terms of the rigidity of the overall gutter structure or the rigidity of its attachment to a building surface.

Accordingly, there is a need for an improved rain gutter having a cover for deflecting leaves and debris and that does not involve the shortcomings of the previously-disclosed arrangments.

SUMMARY OF THE INVENTION

Briefly stated, in accordance with one aspect of the present invention, a rain gutter assembly is provided for collecting surface water runoff from a building roof without clogging of the gutter by leaves and other debris. The rain gutter is in the form of a substantially U-shaped, elongated gutter for placement along and adjacent to a sloping roof of a building for collecting rain water runoff from the roof. The gutter includes a rear wall that is adapted to abut a substantially vertical building surface adjacent to an edge of the roof. A bottom wall extends substantially perpendicularly from the rear wall, and a front wall extends upwardly from a front edge of the bottom wall, so that the rear wall, the bottom wall, and the front wall together define a U-shaped channel having an upwardly-facing opening. The front wall of the gutter has a vertical height that is less than that of the rear wall and includes at its uppermost edge an inwardly-extending lip.

At least two support brackets are positioned within the gutter and spaced from each other along the gutter channel. Each bracket includes at least one passageway for receiving a connector for connecting the gutter to the building surface. The brackets extend across the gutter channel between each of the gutter rear wall and the gutter front wall.

A cover overlies the gutter opening and supported by the at least two brackets. The cover includes a plate-like cover body that overlies and is spaced above the gutter opening. A rear wall of the cover extends along a rear edge of the cover body and defines a contact surface for contacting the gutter rear wall. An inturned front wall of the cover defines a curved front surface of the cover body and terminates at a front edge of the cover body that lies between the gutter front wall and the gutter rear wall. The front edge of the cover body is secured to the at least two brackets, and the cover body rear wall and gutter rear wall are adapted to be jointly secured to the building surface.

BRIEF DESCRIPTION OF THE DRAWINGS

The structure, operation, and advantages of the present invention will become further apparent upon consideration of the following description, taken in conjunction with the accompanying drawings in which.

DESCRIPTION OF THE PREFERRED EMBODIMENTS

Figure 1:
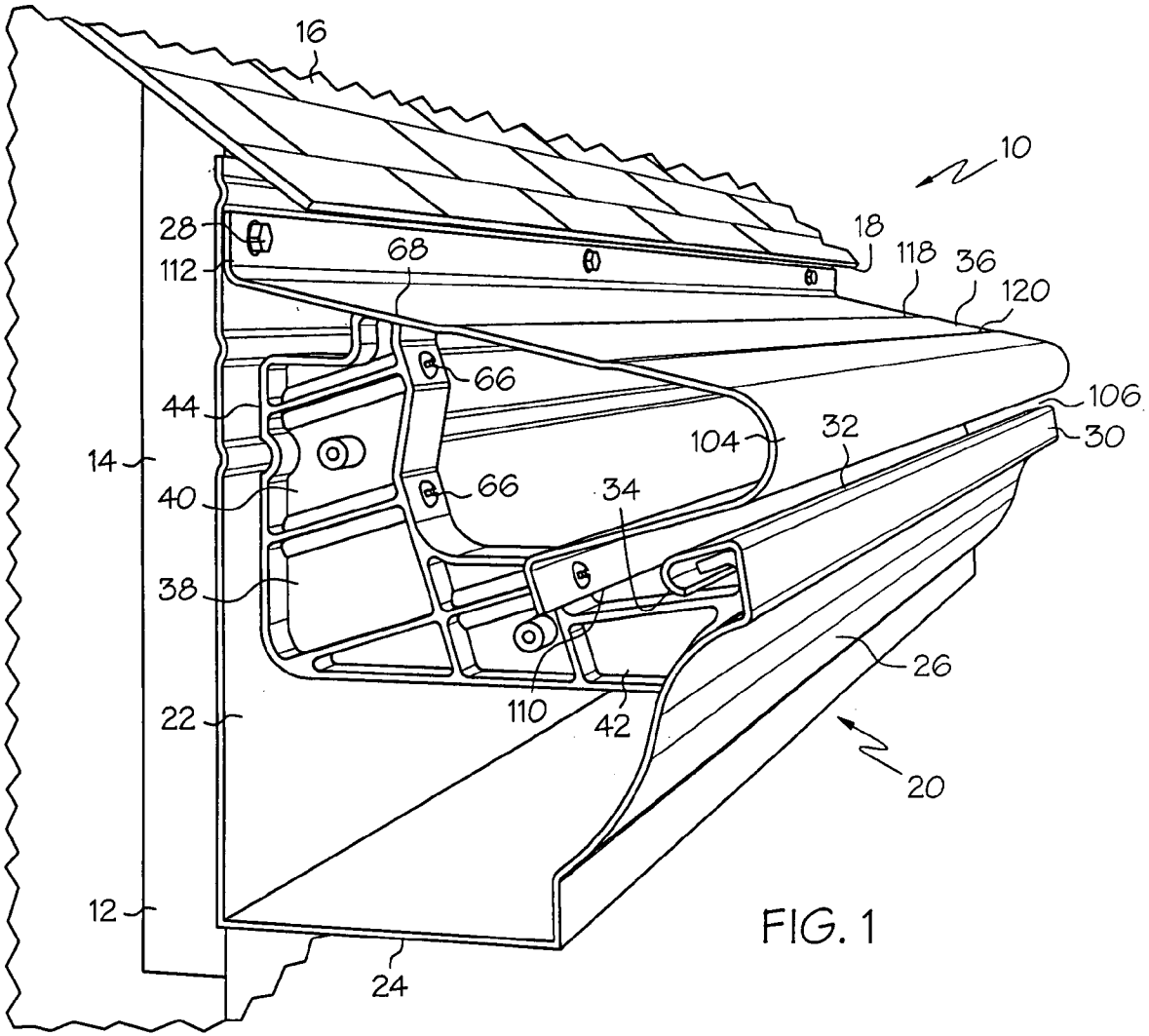
FIG. 1 is a fragmentary front perspective view of a gutter embodiment including a gutter, a gutter support bracket, and a gutter cover, but without a gutter end cap.
Figure 2:
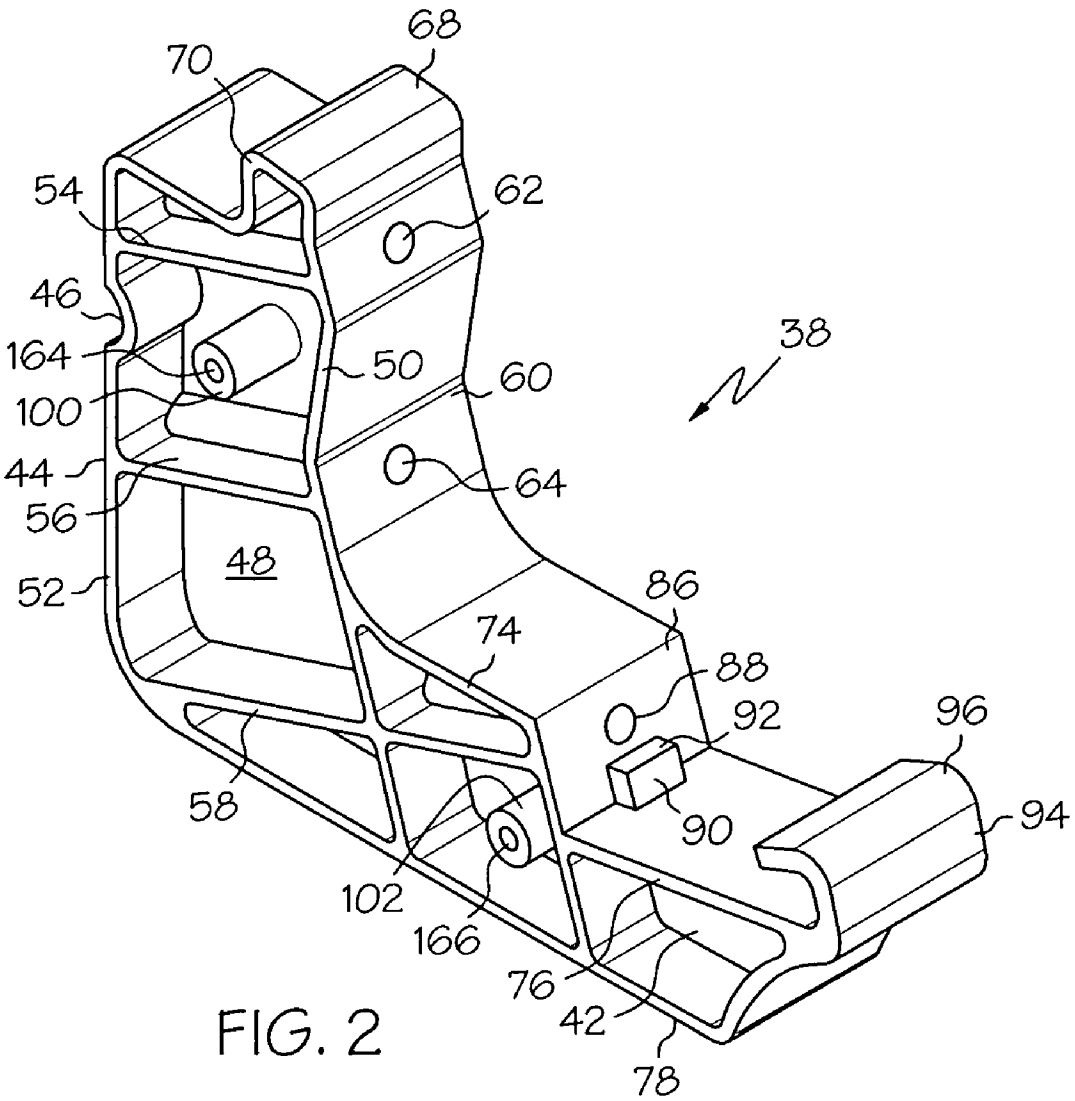
FIG. 2 is an enlarged front perspective view of the gutter support bracket shown in FIG. 1.

Referring to the drawings, and particularly to FIG. 1 thereof, there is shown an embodiment of a rain gutter 10 in accordance with the present invention. Gutter 10 is mounted against a vertically-extending fascia board 12 positioned on a side of a building 14 that includes a sloping roof surface 16. The lower edge 18 of roof surface 16 extends outwardly beyond the surface of fascia board 12 a predetermined distance, of the order of from about 1 in. to about 2 in., and gutter 10 is positioned below roof lower edge 18 to catch water runoff from the roof.

Gutter 10 includes a generally U-shaped, open-top channel member 20 that is defined by a rear wall 22, a bottom wall 24, and a front wall 26. Rear wall 22 is substantially flat and is adapted to lie against the outer surface of fascia board 12 and to be secured thereto by a number of spaced fasteners 28, such as screws, nails, or the like, as shown in FIG. 1. Bottom wall 24 is substantially flat, extends outwardly from the lower edge of rear wall 22, away from fascia board 12, and is substantially perpendicular thereto. And front wall 26 extends generally upwardly from the outermost edge of bottom wall 24. As can be seen from FIG. 1, front wall 26 has a vertical extent that is less than that of rear wall 22.

Front wall 26 can have a cross section in the general form of a flattened "S", as shown in FIG. 1, or it can be straight and extend upwardly parallel to or inclined relative to rear wall 22, or it can have any other desired convenient shape. The uppermost end 30 of front wall 26 includes an inwardly-extending lip 32 that terminates at a reentrant edge 34 or flange that extends in a generally outward direction to define a hook-shaped structure.

Gutter channel 20 can be formed from various well-known gutter materials, including metals such as copper, aluminum alloy, or the like, as well as from plastics. An advantageous material is aluminum alloy sheet that can conveniently be supplied in the form of a coil formed from a narrow, elongated aluminum alloy sheet of a thickness of the order of about 0.032 in. The sheet can be formed into a gutter on-site by uncoiling the aluminum alloy sheet and drawing it through a suitable forming die to bend the sheet into an elongated, generally U-shaped trough or channel such as channel 20 shown in FIG. 1. Using such aluminum alloy coils enables the formation of a continuous, seamless gutter section of any desired length. When made from a plastic material, such as polypropylene, polyvinyl chloride, or the like, the gutter can be pre-formed by extrusion of the plastic material through a suitably shaped extrusion die, cut into desired lengths, and transported to the building site. However, such plastic gutters might not be seamless, depending upon the lengths of the individual gutter sections and the length of the roof edge under which they are to be mounted.

As shown in FIG. 1, gutter 10 includes gutter cover 36 that is also secured to fascia board 12, along with gutter rear wall 22, by fasteners 28. Additionally, a plurality of support brackets 38 are positioned within gutter channel 20 and are spaced from each other along the length of gutter 10 at predetermined intervals. Brackets 38 support gutter channel 20 and gutter cover 36 to provide a strong, rigid gutter assembly.

FIGS. 2 through 5 show gutter support bracket 38 in greater detail. Bracket 38 is generally L-shaped and includes a first leg 40 that extends substantially vertically, and a second leg 42 that extends substantially horizontally when bracket 38 is in its installed position. Legs 40 and 42 are positioned relative to each other at substantially a right angle.

First leg 40 includes a generally flat mounting surface 44 that defines a rear surface of bracket 38 and that is parallel to the outer surface of a fascia board or similar building element when the bracket is in its operative position within a gutter. Mounting surface 44 can include a recess 46 to accommodate a similarly-shaped ridge (not shown), which can be provided in a gutter rear wall for stiffening purposes or to facilitate locating the bracket relative to the gutter rear wall. Leg 40 can be defined by a flat central panel 48 with laterally-extending peripheral flanges 50, 52, and it also can include a plurality of interiorly-positioned ribs 54, 56, and 58 that extend between and interconnect respective peripheral flanges 50, 52. Flanges 50, 52 and ribs 54, 56, 58 serve to stiffen and to provide greater structural rigidity to leg 40.

Figure 3:
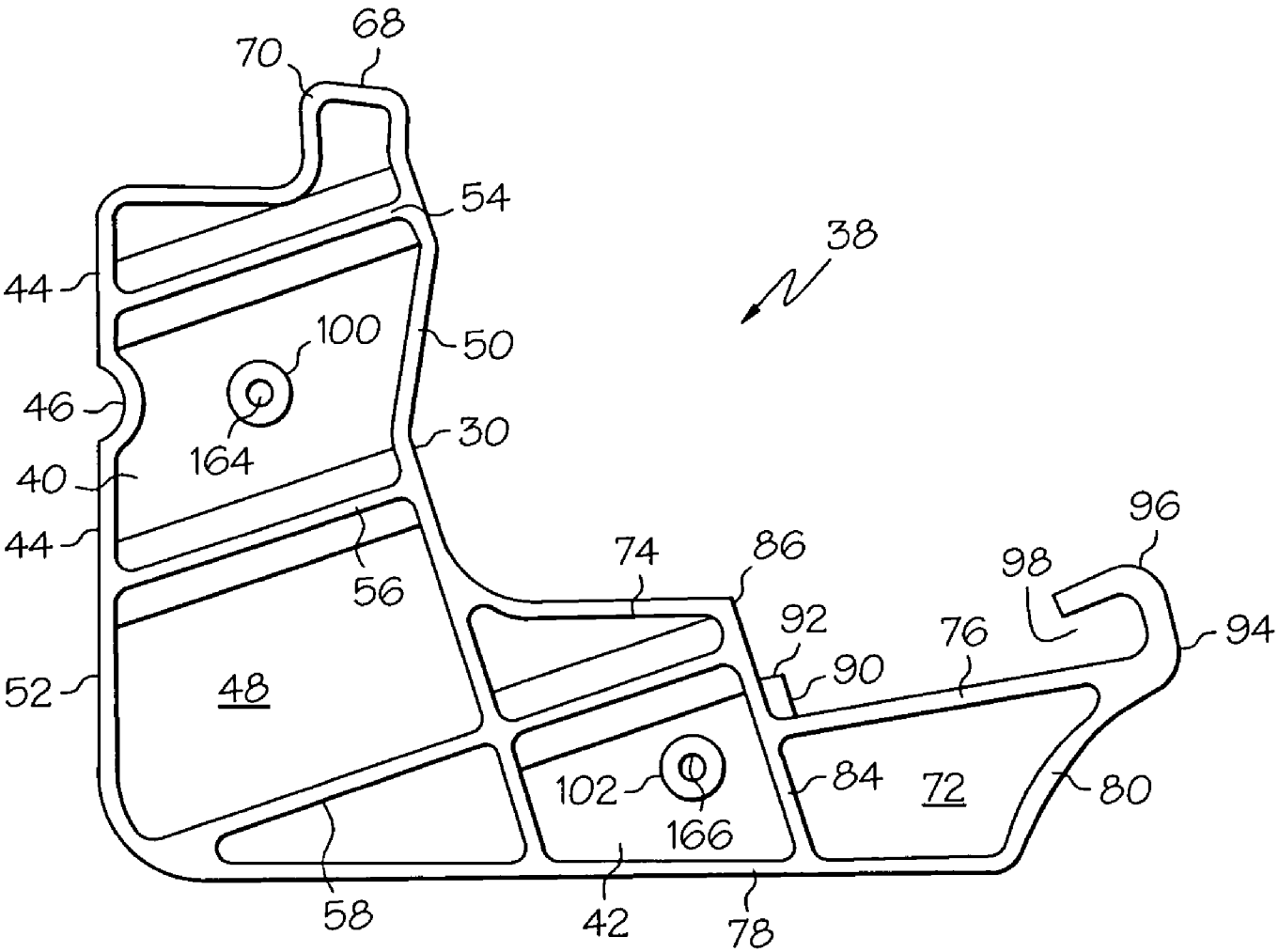
FIG. 3 is a side elevational view of the gutter support bracket shown in FIG. 1.
Figure 5:
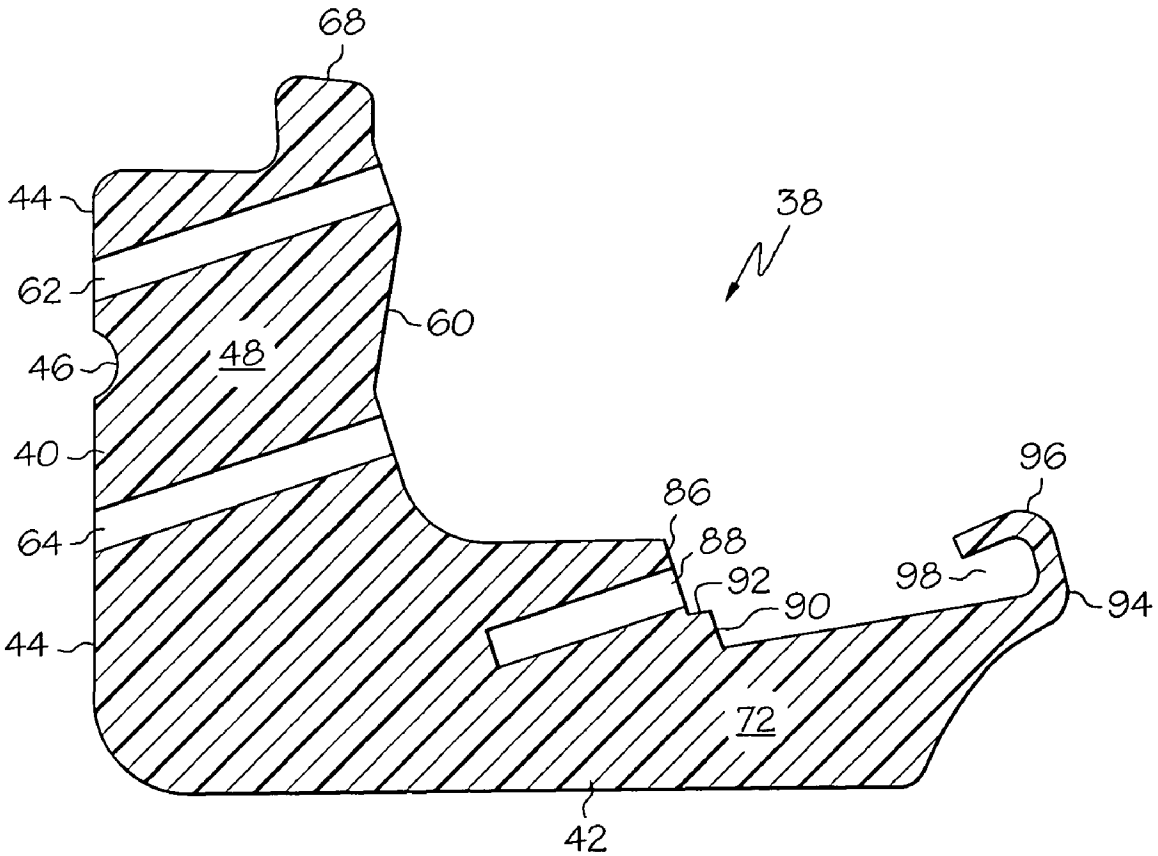
FIG. 5 is a cross-sectional view taken along the line 5—5 of FIG. 4.
Figure 4:
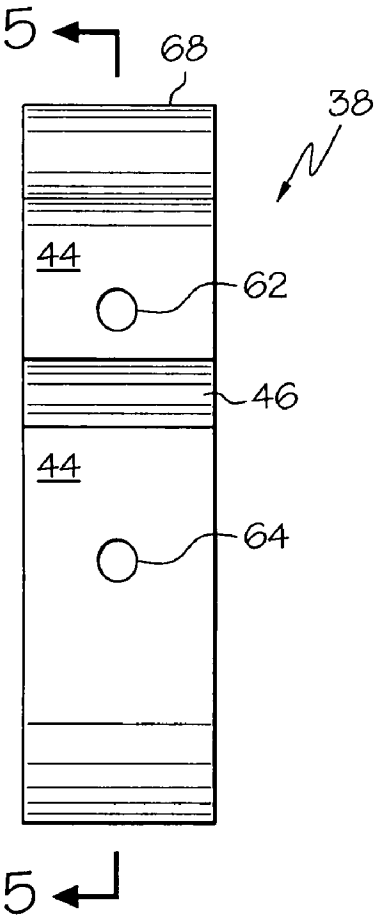
FIG. 4 is a rear view of the gutter support bracket shown in FIG. 1.

Extending inwardly from front surface 60 of leg 40 to mounting surface 44, and best seen in FIG. 5, are a pair of throughbores 62, 64 that are adapted to receive fasteners 66 (see FIG. 1) for fastening the gutter assembly to a fascia board or a building wall surface. Suitable fasteners are nails and screws. As is apparent from FIG. 5, the axes of throughbores 62, 64 are inclined relative to mounting surface 44, to provide for ease of access to the fasteners by an installer when applying the fasteners for attaching the bracket and gutter to the building surface. Throughbores 62, 64 extend within and along flat central panel 48 and can be parallel to each other as shown in FIGS. 3 and 5.

Also included on bracket 38, at the upper end of first leg 40, is a generally upwardly-facing support surface 68 for supporting gutter cover 36 by limiting downward movement of the cover. Support surface 68 is preferably flat and can be defined by a laterally-extending flange 70 that extends between and interconnects flanges 50 and 52. Support surface 68 is inclined in a downward direction from a plane defined by mounting surface 44 and extends toward a gutter front wall engagement means 96. The inclination angle of support surface 68 is from about 85° to about 65° relative to mounting surface 44.

Second leg 42 is adapted to be oriented in a generally horizontal direction relative to the vertically-extending building surface. Leg 42 can be defined by a flat central panel 72 with laterally-extending peripheral flanges 74, 76, 78, 80, and it also can include a plurality of interiorly-positioned ribs 82, 84 that extend between and interconnect respective peripheral stiffening flanges 74, 78. Ribs 82, 84 can be oriented to be substantially perpendicular to ribs 56, 58 of first leg 40. As was the case with the flanges and ribs provided on first leg 40, flanges 50, 52 and ribs 82, 84 serve to stiffen and to provide greater structural rigidity to leg 42.

Extending inwardly from surface 86 of leg 42, and best seen in FIG. 5, is a blind bore 88 that is adapted to receive a fastener for fastening to bracket 10 a front edge panel of gutter cover 36 (see FIG. 1). Suitable fasteners can be, again, nails, screws, and the like. As is apparent from FIG. 5, the axis of blind bore 88 can be oriented to be parallel to the axes of throughbores 62, 64. The angular orientation of blind bore 88 facilitates access to the fasteners when applying fasteners for attaching gutter cover 36 to bracket 38.

Arranged below the opening to blind bore 88 in surface 86 is a projection 90 that extends outwardly from surface 86 to define a positioning stop that includes an upwardly-facing stop surface 92. Stop surface 92 of projection 90 serves as a stop against which an edge of the gutter cover front panel can be positioned to orient the gutter cover front panel relative to bracket 38.

Provided at the outermost lateral end 94 of second leg 42 is a hook-shaped end member 96 that has an inner opening 98 that opens to face surface 86. End member 96 is configured to engage with a front recess formed in gutter front wall 26 to provide a front support for the gutter. Opening 98 is adapted to receive inturned lip 32 (see FIG. 1) at the free end of gutter front wall 36 as additional security against gutter 20 slipping down from bracket 38.

Each of first leg 40 and second leg 42 can include one or more laterally-outwardly-extending connection members 100, 102, such as bosses extending from central panels 48, 73, respectively. Connection members 100, 102 can have a tubular form as shown and can include respective openings 164, 166 for receiving a fastener, such as a connecting screw, for connecting a gutter end cap adjacent a gutter end, as described below.

Figure 9:
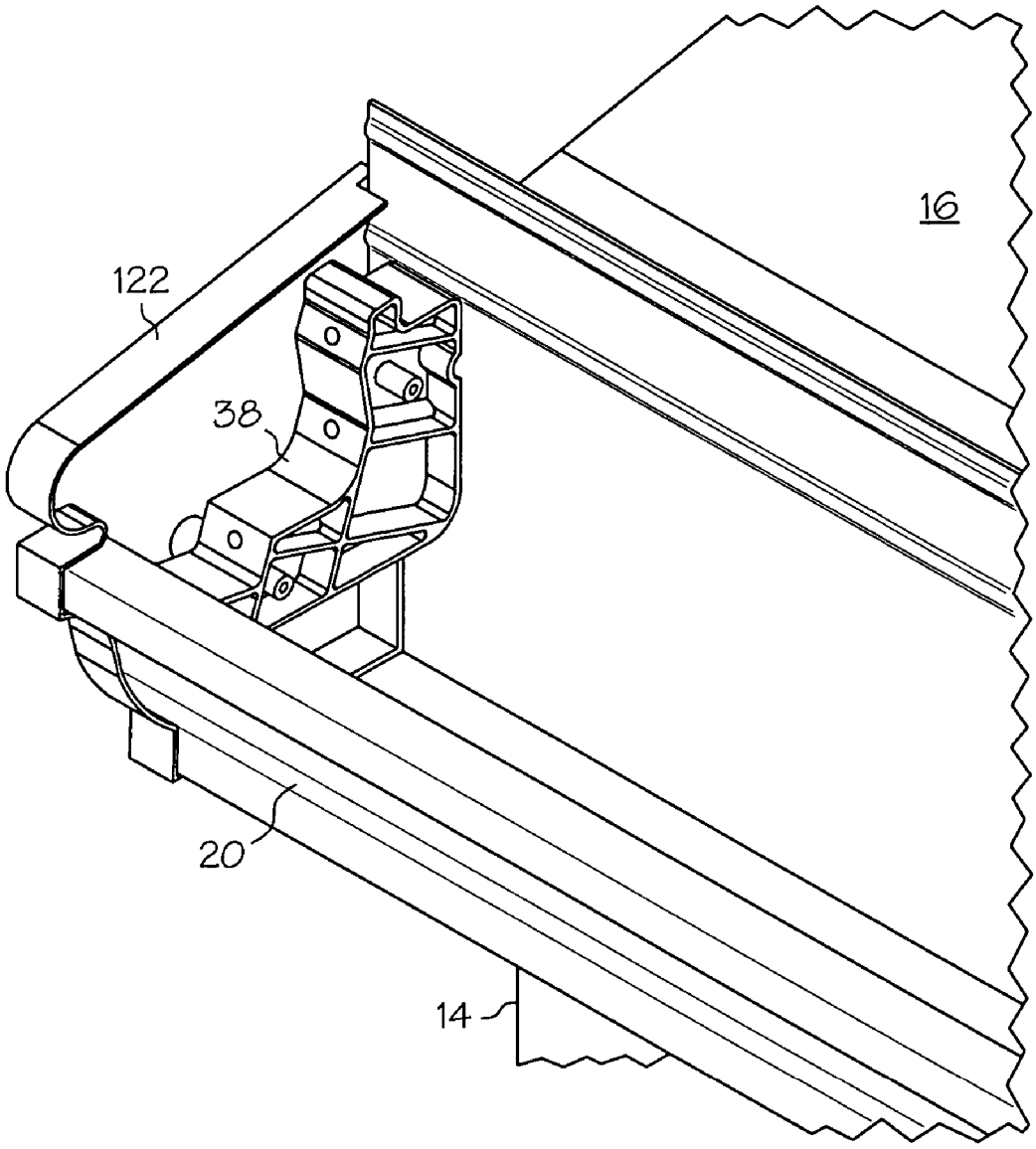
FIG. 9 is a fragmentary top perspective view adjacent an end of the gutter with the cover omitted.

Bracket 38 is shown in its installed position within a gutter in FIGS. 1 and 9 and is secured to fascia board 12 by two screws 66 that are received in throughbores 62, 64 within bracket 38. Screws 66 pass through gutter rear wall 22 that lies between bracket mounting surface 44 and the surface of fascia board 12. The upper front end 30 of gutter 20 is supported by hook-shaped end member 96 of bracket 38 (see FIGS. 1 and 2), which receives inturned lip 32 of front end 30 of gutter 20. In actual use, several brackets 38 are spaced along gutter 20, at a suitable predetermined spacing, which can be approximately 24 inches center-to-center. As a result, gutter 20 is fully and securely supported on fascia board 12 by a series of spaced brackets 38.

Brackets 38 can advantageously be formed from a rigid plastic material by injection molding. Suitable materials include ABS, polypropylene, and the like.

Gutter cover 36, which serves as a deflector of leaves, branches, twigs, and other forms of debris, is a substantially flat, elongated, plate-like panel that extends from gutter rear wall 22 to a cover forward end 104, to overlie gutter channel 20, and then curves inwardly into gutter channel 20. Cover forward end 104 is a convexly-curved front surface that has an inner end defined by an end panel 106 that is bent to extend in a downward direction, toward gutter bottom wall 24. A gap to allow water to flow into the gutter is provided between cover forward end 104 and front end 30 of gutter channel 20. The gap defines an opening of the order of from about ¼ in. to about ½ in., which is sufficiently large to allow entry of water into the gutter but to prevent the entry into the gutter of leaves and other debris.

Figure 11:
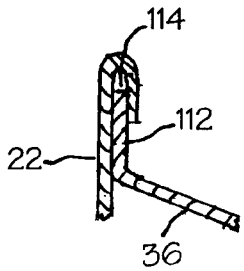
FIG. 11 is a fragmentary cross-sectional view showing the interconnection of the gutter rear wall with the cover rear wall.

End panel 106 of cover 36 is a flat panel that is secured to respective brackets 38 by screws 108. End panel 106 includes a front edge 110 that is received on respective stop surfaces 92 of brackets 38. Stop surfaces 92 allow accurate positioning of front edge 110 of cover 36 so that cover forward end 104 is uniformly spaced from gutter upper end 30 along the entire length of the assembled gutter. As shown in FIG. 11. the inner end of cover 36 adjacent to building 14 has an upturned lip 112 that is secured relative to fascia board 12 by a series of spaced screws 28. Lip 112 of cover 36 is in the form of a flange that extends upwardly, relative to gutter channel 20, and is received in a downwardly-facing slot 114 that is formed by bending over the uppermost edge of gutter rear wall 22. Additionally, the inner end of cover 36 is also supported on its inwardly-facing surface and in a vertical direction by support surfaces 68 of respective spaced brackets 38.

Gutter cover 36 can be made from the same types of materials and can be formed in a manner similar to that of gutter channel 20. Cover 36 can include one or more spaced, parallel, raised steps 118, 120 that extend along the length of the cover and serve to momentarily slow the flow of water over cover 36, to divert some of the water to flow laterally in order for the flow of water to be distributed substantially uniformly along the length of the cover, and to flow over and around outer end 104 of cover 36 to remain in contact with the surface of outer end 104 and to flow into gutter channel 20.

Figure 6:
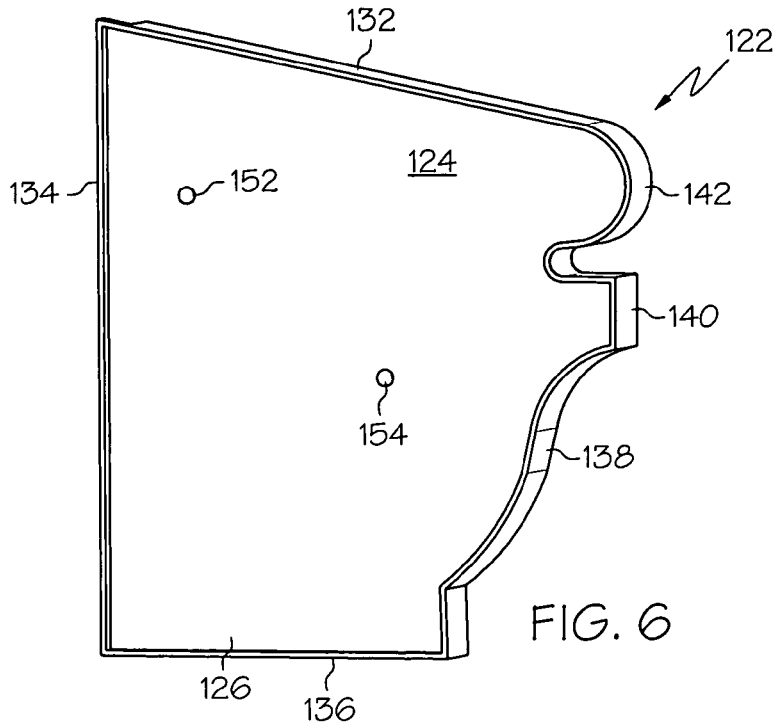
FIG. 6 is a perspective view of the outer surface of an embodiment of a gutter end cap.
Figure 7:
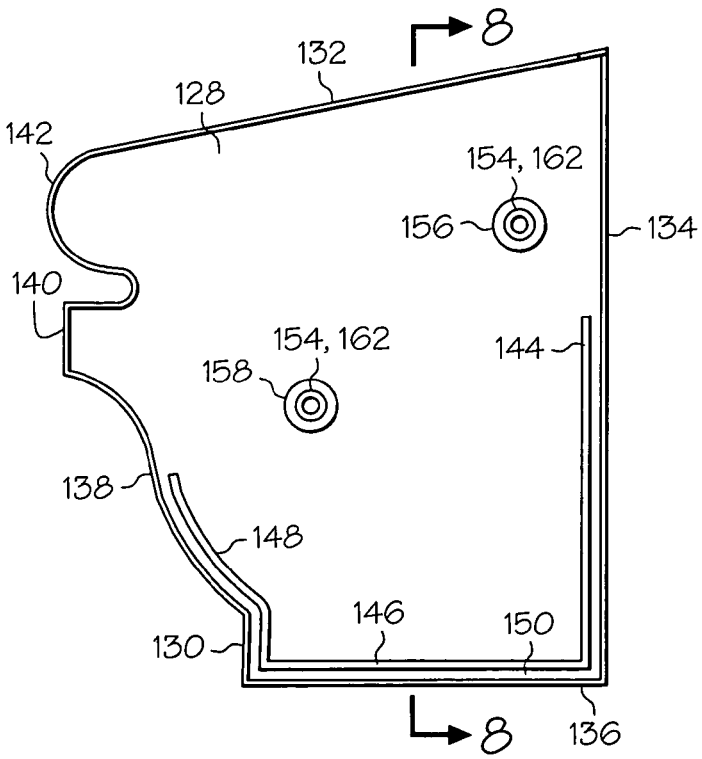
FIG. 7 is an elevational view of the inner surface of the gutter end cap shown in, FIG. 6.
Figure 8:
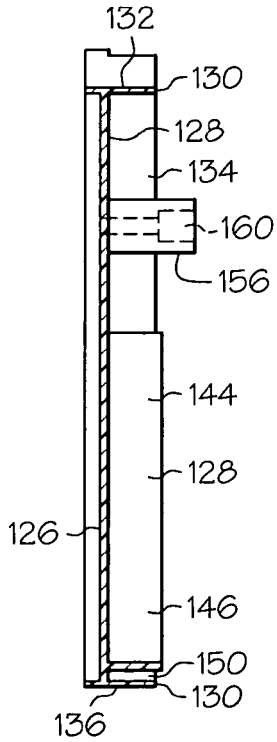
FIG. 8 is a cross-sectional view taken along the line 8—8 of FIG. 7.

FIGS. 6 through 8 show an end cap 122 that is configured so that it can be applied at an end of gutter channel 20 to overlie the end of the gutter channel and the space between the gutter channel and the gutter cover to serve as a water block as well as a leaf and debris deflector. End cap 122 includes an end panel 124 that is substantially flat, although it could be made to be slightly convex or concave, if desired. End panel 124 includes an outer face 126 and an inner face 128, and it has a perimeter that corresponds in shape with that of the cross section that is defined by gutter channel 20 and gutter cover 36, so that when end cap 122 is attached at an end of the gutter it completely closes the end of the gutter-cover assembly. Although only a left hand end cap is shown and described, it will be apparent to those skilled in the art that a right hand end cap will be the mirror image of the left hand end cap.

Positioned along the perimeter of end panel 124 is a peripheral flange 130 that extends from end panel 124 in a direction toward the gutter to which end cap 122 is intended to be applied. Flange 130 is substantially perpendicular to inner face 128 and is a substantially continuous outer peripheral wall that defines an end cap top wall 132, an end cap rear wall 134, an end cap bottom wall 136, and an end cap front wall 138. Top wall 132 and rear wall 134 define an included angle of less than 90°, because gutter cover panel 36, as shown in FIG. 1, slopes downwardly away from building 14 to which gutter 10 is attached, to allow the roof runoff to flow over gutter 20 and toward outer end 104 at the front of the gutter. Bottom wall 136 is substantially perpendicular to rear wall 134, while front wall 138 has a shape that corresponds with that of front wall 26 of gutter channel 20. As shown, front wall 138 is generally S-shaped in cross section and includes a first outward projection 140 that corresponds in shape with the cross-sectional shape of upper end 30 of gutter channel 20, and a second outward projection 142 that corresponds in shape with the cross-sectional shape of gutter cover 36.

As best seen in FIGS. 7 and 8, spaced inwardly of a portion of end cap rear wall 134, and parallel thereto, is a first inner wall 144. Similarly, spaced inwardly of and parallel to end cap bottom wall 136 is a second inner wall 146, and spaced inwardly of a portion of front wall 138 and parallel thereto is a third inner wall 148. Inner walls 144, 146, and 148 together with outer walls 134, 136, and 138 define a slot 150 that has a spacing corresponding substantially with the wall thickness of the corresponding gutter walls, so that end cap 122 fits snugly and in substantially leak-proof engagement with the end of gutter channel 20 when it is installed thereon.

As seen in FIG. 6, outer face 126 of end panel 124 includes a pair of apertures 152, 154. The apertures receive connecting screws that are inserted therethrough to securely connect end cap 122 with a gutter bracket 38 having correspondingly positioned openings, so that end cap 122 can be screwed to bracket 38 and thereby remain securely in place at the end of the gutter. Additionally, extending inwardly from inner face 128 of end cap 122, and coaxially aligned with apertures 152, 154 is a pair of bosses 156, 158, respectively, which include respective passageways 160, 162 that are aligned with respective ones of apertures 152, 154. Bosses 156, 158 can have a length such that the free ends of the bosses are in contact with gutter bracket 38. Passageways 160, 162 serve to guide the connecting screws to contact the bracket at correspondingly positioned screw-receiving apertures 164, 166 provided in connectors 100, 102 respectively, of bracket 38.

FIG. 9 is a top perspective view of an assembled and installed gutter 20 in which one bracket 38 is shown adjacent an end of the gutter, but without the gutter cover shown in FIG. 1. Gutter 20 includes end cap 122 that serves to close off the open end of the gutter so that water collected within gutter 66 is confined to flow to one or more downspout openings (not shown) provided in gutter 20.

Figure 10:
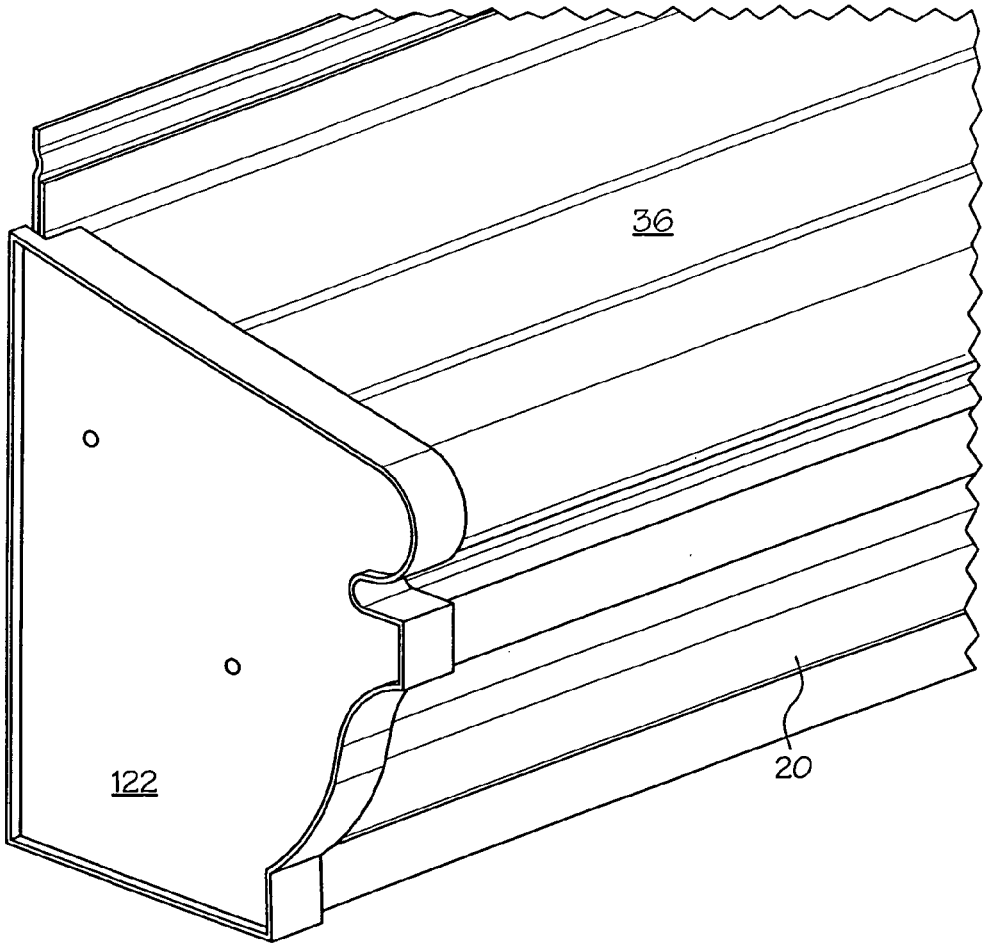
FIG. 10 is a fragmentary perspective view of the gutter shown in FIG. 1 with an end cap attached to the gutter end.

FIG. 10 is an end view of a fully assembled gutter assembly 10, including gutter channel 20, gutter cover 36 and end cap 122.

Although particular embodiments of the present invention have been illustrated and described, it will be apparent to those skilled in the art that changes and modifications can be made without departing from the spirit of the present invention. Accordingly, it is intended to encompass within the appended claims all such changes and modifications that fall with the scope of the present invention.

What is claimed is:

1. A rain gutter assembly for collecting surface water runoff from a building roof without clogging of the gutter by leaves and other debris, said rain gutter comprising:

a) a substantially U-shaped, elongated gutter for placement along and adjacent to a sloping roof of a building for collecting rain water runoff from the roof, the gutter including a rear wall that is adapted to abut a substantially vertical building surface adjacent to an edge of the roof, a bottom wall extending substantially perpendicularly from the rear wall, and a front wall extending upwardly from a front edge of the bottom wall, wherein the rear wall, the bottom wall, and the front wall together define a U-shaped channel having an upwardly-facing opening, the front wall having a vertical height that is less than that of the rear wall and including at its uppermost edge an inwardly-extending lip;

b) at least two support brackets positioned within and spaced from each other along the gutter channel and including at least one passageway for receiving a connector for connecting the bracket and gutter to the building surface, the brackets extending across the gutter channel and between and engaging each of the gutter rear wall and the gutter front wall and including:

1) a substantially L-shaped body including a first leg adapted to be oriented substantially vertically when the bracket is installed in the gutter, and a second leg adapted to be oriented substantially horizontally when the bracket is installed in the gutter, the first leg including a mounting surface adapted to contact the rear wall of the gutter;

2) at least one first passageway extending through the first leg toward the mounting surface and angularly aligned with the second leg for receiving a connector for connecting the bracket and gutter to a substantially vertical building surface adjacent to a roof edge;

3) at least one second passageway extending into the second leg for receiving a cover fastener for securing a gutter cover to the support bracket;

4) engagement means carried by the second leg for engaging and supporting a front wall portion of a gutter: and 5) cover support means carried by the first leg for contacting a downwardly-facing surface at a rear portion of a gutter cover, wherein the cover support means is an upwardly-facing, flat support surface inclined in a downward direction from a plane defined by the mounting surface and extending toward the gutter front wall engagement means; and c) a gutter cover overlying the gutter opening and supported by the at least two brackets, wherein the cover includes a plate-like cover body having a rear portion being supported by the cover support means of the brackets such that the cover body angularly overlies and is spaced above the gutter opening, a rear wall extending along a rear edge of the cover body and defining a contact surface that contacts the gutter rear wall, and an inturned front wall that defines a curved front surface of the cover body and that terminates at a front edge of the cover body that lies between the gutter front wall and the gutter rear wall, wherein the front edge of the cover body is supported by the and secured to the at least two brackets by a cover fastener extending through the second passageway and wherein the cover body rear wall and gutter rear wall are adapted to be jointly secured to the building surface by a fastener that extends through both the cover body wail and the gutter rear wall.

2. A rain gutter in accordance with claim 1, wherein the gutter rear wall has an uppermost end that is folded over to define a slot that receives the cover rear wall.

3. A rain gutter in accordance with claim 1, wherein the gutter front wall includes a reentrant flange extending toward the gutter front wall.

4. A rain gutter in accordance with claim 3, wherein the reentrant flange engages the engagement means of the second legs of each of the brackets.

5. A rain gutter in accordance with claim 4, wherein the engagement means include a reentrant flange that extends in an opposite direction to that of the gutter front wall reentrant flange to support the gutter front wall portion in a vertical direction.

6. A rain gutter in accordance with claim 1, wherein the front surface of the cover body is spaced from the gutter front wall to define a gap therebetween into which water can flow from the cover upper surface into the gutter channel.

7. A rain gutter in accordance with claim 6, wherein the gap has an opening of from about ¼ in. to about ½ in.

8. A rain gutter in accordance with claim 1, wherein the front surface of the cover body overlies the gutter lip to block leaves and debris from entering the gutter channel.

9. A rain gutter in accordance with claim 1, wherein the first leg includes at least two first passageways.

10. A rain gutter in accordance with claim 1, wherein the at least one second passageway is a blind bore.

11. A rain gutter in accordance with claim 1, wherein the engagement means is a hook member that is adapted to engage a reentrant flange carried at an upper front edge of a gutter.

12. A rain gutter in accordance with claim 1, wherein the cover support surface is inclined at an inclination angle of from about 85° to about 60° relative to the mounting surface.

13. A rain gutter in accordance with claim 1, wherein the cover support surface is inclined relative to the mounting surface at an inclination angle of about 75°.

14. A rain gutter in accordance with claim 1, including a stop surface carried by the second leg for abutment with and for positioning relative to the bracket of a front edge of the gutter cover.

15. A rain gutter in accordance with claim 14, wherein the stop surface is positioned below an opening of the at least one second bore.

16. A rain gutter in accordance with claim 1, including at least one aperture in the bracket body for receiving a fastener for fastening an end cap to an adjacent bracket.

17. A rain gutter in accordance with claim 16, wherein the at least one bracket body aperture is positioned in the first leg.

18. A rain gutter in accordance with claim 16, wherein the at least one bracket body aperture is positioned in the second leg.

19. A rain gutter in accordance with claim 16, wherein at least one bracket body aperture is positioned in the first leg, and at least one bracket body aperture is positioned in the second leg.

20. A rain gutter in accordance with claim 1, including a gutter end cap comprising:

a) an end panel having an inner surface and an outer surface and including a perimeter having a predetermined shape;

b) first connection means carried by the end panel for connecting the end cap with an end of the gutter; and c) second connection means carried by the end panel for connecting the end cap with an adjacent support bracket carried within the gutter.

21. A rain gutter in accordance with claim 20, wherein the first connection means includes an outer peripheral wall extending laterally outwardly from the inner face of the end panel and an inner peripheral wall extending laterally outwardly from the inner face of the end panel and positioned inwardly of the outer peripheral wall to define therebetween a connection slot for connecting the end cap with and end of the gutter.

22. A rain gutter in accordance with claim 21, wherein the outer peripheral wall defines an end cap top wall, an end cap rear wall, an end cap bottom wall, and an end cap front wall.

23. A rain gutter in accordance with claim 22, wherein the outer peripheral wall is substantially continuous.

24. A rain gutter in accordance with claim 23, wherein the outer peripheral wall and the inner peripheral wall are substantially perpendicular to the end panel inner surface.

25. A rain gutter in accordance with claim 24, wherein the inner peripheral wall extends laterally outwardly from the end panel inner surface a greater distance than the outer peripheral wall.

26. A rain gutter in accordance with claim 22, wherein the inner peripheral wall extends substantially along and parallel to the end cap front wall, the end cap bottom wall, and the end cap rear wall.

27. A rain gutter in accordance with claim 26, wherein the inner peripheral wall extends along the end cap rear wall from a point between the end cap top wall and the end cap bottom wall, along the end cap bottom wall, and along the end cap front wall to a point between the end cap top wall and the end cap bottom wall.

28. A rain gutter in accordance with claim 23, wherein the outer peripheral wall includes a gap between the end cap top wall and the end cap rear wall to receive a portion of the gutter rear wall.

29. A rain gutter in accordance with claim 20, wherein the second connection means includes at least one aperture in the end panel for receiving a connecting member for connection with the adjacent support bracket.

30. A rain gutter in accordance with claim 20, wherein the second connection means includes a projection extending outwardly from the end panel inner surface for contacting the adjacent support bracket.

31. A rain gutter in accordance with claim 30, wherein the projection includes a passageway for receiving a connecting member that interconnects the end cap with the adjacent support bracket.

32. A rain gutter in accordance with claim 30, wherein the projection terminates in a connector engageable with the adjacent support bracket.

33. A rain gutter in accordance with claim 1, including a rain gutter end cap comprising: a first, gutter-trough closure region for blocking water flow from a gutter end, and a second, above-trough closure region for blocking entry of debris between the gutter and the overlying gutter cover.

* * * * *